US006019621A

United States Patent [19]

Sugata et al.

[11] Patent Number: 6,019,621

[45] **Date of Patent: *Feb. 1, 2000**

[54] ELECTRICAL CONNECTOR FOR USE IN AN AUTOMOBILE TO PREVENT THE SLIDING AND WINDING NOISE CAUSED BY A CABLE REEL OF CABLE

[75] Inventors: Shoichi Sugata, Yokkaichi; Yoshihiro Tsujita, Tokyo, both of Japan

[73] Assignees: Sumitomo Wiring Systems, Ltd; Nippon Valqua Industries, Ltd., both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/988,411

[22] Filed: Dec. 10, 1997

[30] Foreign Application Priority Data

Dec. 13, 1996 [JP] Japan ..... 8-333651

[51] Int. Cl.[7] ..... H01R 3/00

[52] U.S. Cl. ..... 439/164; 439/15

[58] Field of Search ..... 439/164, 15; 350/96.23; 242/388

[56] References Cited

U.S. PATENT DOCUMENTS

| | | | |
|---|---|---|---|
| 4,741,594 | 5/1988 | Suzuki | 350/96.23 |
| 4,921,428 | 5/1990 | Sasaki et al. | 439/15 |
| 5,637,005 | 6/1997 | Bannai et al. | 439/164 |
| 5,647,753 | 7/1997 | Ishikawa et al. | 439/689 |
| 5,707,023 | 1/1998 | Ichikawa et al. | 242/388 |
| 5,772,146 | 6/1998 | Kawamoto et al. | 242/388 |
| 5,800,190 | 9/1998 | Ichikawa et al. | 439/164 |

FOREIGN PATENT DOCUMENTS

| | | |
|---|---|---|
| 6-36040 | 9/1994 | Japan . |
| 8-104471 | 4/1996 | Japan . |
| 8-162242 | 6/1996 | Japan . |

OTHER PUBLICATIONS

Chem. Abstracts, vol. 124, No. 14, Apr. 1, 1998, Sagawa Masoto.

Patent Abstracts of Japan, vol. 16, No. 113 (p–1327) Mar. 19, 1992 & JP 03 284782 A Dec. 16, 1991 (Sumitomo Electric Ind. Ltd.) Abstract.

Patent Abstracts of Japan, vol. 96, No. 10, Oct. 31, 1996 & JP 08 162242A Yazaki Corp. Jun. 21, 1996.

Patent Abstracts of Japan, vol. 96, No. 8, Aug. 30, 1996 & JP 08 104471 A.

Japanese Abstract No. HEI 8–162242 (1996) (3 pages).

Japanese Abstract No. HEI 8–104471 (1996) (6 pages).

*Primary Examiner*—Stephen R. Funk
*Assistant Examiner*—Charles H. Nolan, Jr.
*Attorney, Agent, or Firm*—Jordan B. Bierman; Bierman, Muserlian and Lucas

[57] ABSTRACT

A highly lubricative sound-absorbing material is produced inexpensively and attenuates sliding noise and vibration noise. The highly lubricative sound-absorbing material comprises a rubber sheet (21) and a highly lubricative coating layer (22) formed directly on a surface of the rubber sheet by coating the surface with a mixture of an adhesive and a fluororesin system coating agent such as an polytetrafluoroethylene resin or the like by a thickness of 1 to 10 $\mu$m. The rubber sheet (21) is formed into an annular shape and coated on its surface with the highly lubricative sound-absorbing layer (22) having a thickness of 1 to 10 $\mu$m, preferably 3 $\mu$m. The rubber sheet (21) is attached to a surface of a cable reel on which a flat cable slides.

6 Claims, 4 Drawing Sheets

ELECTRICAL CONNECTOR FOR USE IN AN AUTOMOBILE TO PREVENT THE SLIDING AND WINDING NOISE CAUSED BY A CABLE REEL OF CABLE

BACKGROUND OF THE INVENTION

This invention relates to a highly lubricative sound-absorbing material and a cable reel including the same, and more particularly it relates to a highly lubricative sound-absorbing material preferably adapted to be used in a cable reel which is mounted on a steering device for an automotive vehicle and electrically interconnects a stationary element assembly and a movable element assembly through a flat cable.

In an automotive vehicle equipped with an air bag, a cable reel is provided in a steering wheel in order to supply electrical power to an air bag system. For convenience of explanation, such a cable reel will be described below by referring to the drawings. FIG. 5 is a schematic longitudinal sectional view of a conventional cable reel. FIG. 6 is a perspective view of a conventional sound-absorbing material. As shown in FIG. 5, the conventional cable reel includes a movable element assembly, which rotates together with a steering wheel and a stationary element assembly 2 which is secured to a stationary shaft on a body frame. The movable and stationary element assemblies 1 and 2 define an annular cable containing chamber 3 which accommodates a flat cable 4 in a swirl manner. Opposite ends of the flat cable 4 in the swirl manner connected to lead wires 6 and 7 which are led out from the movable and stationary element assemblies 1 and 2, respectively, to be connected to an external connector or electrical wires. In such a cable reel, the flat cable 4 is wound in the cable containing chamber 3 when the steering wheel is turned in either a clockwise or counter-clockwise direction while the flat cable 4 is unwound in the chamber 3 when the steering wheel is turned in the other direction, so that a device (air bag) on the steering wheel is electrically connected to a power source on the body frame.

The cable reel involves a problem of unpleasant sliding noise caused when the lateral opposite edges of the flat cable 4 slide on upper and lower bearing walls of the cable containing chamber 3 upon winding and unwinding of the flat cable 4 in the chamber 3. The flat cable 4 caused to vibrate in an axial direction (from upper to lower direction or from lower to upper direction) A of the steering wheel during idling or driving of the automotive vehicle, thereby causing a problem of unpleasant vibration noise due to collision between the bearing surfaces of the chamber 3 and the lateral opposite edges of the flat cable 4.

Japanese Utility Model Publication No. HEI 6-36040 (1994) discloses a cable reel in which a highly lubricative sheet such as an polytetrafluoroethylene resin or the like is adhered to at least one of bearing surfaces of a cable containing chamber in order to attenuate sliding noise. Also, Japanese Patent Public Disclosure No. HEI 8-104471 (1996) discloses a cable reel in which a sound-absorbing material 5 made of a resilient material such as a rubber or the like or a sound-absorbing material 5 with the polytetrafluoroethylene resin is attached to bearing surfaces of stationary and movable element assemblies by means of clamps provided on the surfaces (see FIG. 5).

The polytetrafluoroethylene resin is adhered by way of PET (polyethylene terephthalate) to a surface of a rubber sheet since the former lacks adhesion to the latter.

Although the polytetrafluoroethylene resin sheet disclosed in Japanese Utility Model Publication No. HEI 1-36040 (1994) can attenuate the sliding noise on account of its high lubrication, it cannot reduce noise which is caused by collision of the flat cable onto the bearing surfaces of the cable reel due to axial vibrations of the cable in swirl. In particular, such unpleasant collision noise are likely to be pronounced when an engine is idling. On the other hand, the resilient sheet disclosed in Japanese Patent Publication No. HEI 8-104471 (1996) hardly attenuates sliding noise, since the lubrication between the flat cable and the resilient sheet is poor, although the sheet can reduce the collision or vibration noise.

A rubber sheet having the polytetrafluoroethylene resin provided thereon can attenuate both sliding noise and vibration noise by means of the highly lubricative resin and rubber sheet.

However, as shown in FIG. 6, a rubber sheet 5*a*, a PET film 5*b*, and an polytetrafluoroethylene resin sheet 5*c* must be punched out into an annular shape adapted to be used, since the bearing surfaces of the cable containing chamber is in an annular form. Consequently, this involves much loss of material. In particular, a total cost of the cable reel becomes high since the polytetrafluoroethylene resin sheet is expensive.

In addition, the above lubricative sound-absorbing material involves a high producing cost due to increase of working steps, since the PET film is adhered to the rubber sheet through an adhesive and then the ethylene tetrafluoride resin is adhered to the PET film by way of an adhesive.

Further, the above lubricative sound-absorbing material gives rise a problem in that it reduces a sound-absorbing effect since the hard PET film is interposed between the rubber sheet having a sound-absorbing function and the polytetrafluoroethylene resin having a lubricative function. It is difficult to produce an ethylene tetrafluoride resin sheet having a low thickness since it is produced by means of skiving. Consequently, the sheet on the market is usually more than 20 $\mu$m. Such a thick polytetrafluoroethylene resin sheet in addition to the hard PET film will lower the sound-absorbing function.

SUMMARY OF THE INVENTION

An object of the present invention is to provide a highly lubricative sound-absorbing material and a cable reel including the same which can effectively attenuate both sliding noise and vibration noise and can be produced inexpensively.

In order to achieve the above object, a highly lubricative sound-absorbing material in accordance with the present invention comprises: a rubber sheet and a highly lubricative layer formed directly on a surface of the rubber sheet by coating the surface with a fluororesin system coating agent mixed with an adhesive.

In the prior art, the polytetrafluoroethylene resin is formed into a sheet beforehand and the resin sheet is attached to the rubber sheet through the PET film, since it is difficult to directly adhere the resin sheet to the rubber sheet. However, in the highly lubricative sound-absorbing material of the present invention, a fluororesin system coating agent in a liquid form is mixed with the adhesive prior to being formed into a sheet, and the mixture in liquid form is applied directly onto the surface of the rubber sheet by means of a spray, a brush, or a roller, and then the coated layer is heated to a given temperature and hardened to form a very thin and highly lubricative coating layer on the rubber sheet.

When the fluororesin system coating agent is used as it is and the agent mixed with the adhesive is applied onto the rubber sheet, the agent will get to fit on the rubber sheet and thus it is possible to directly form the highly lubricative coating layer made of the fluororesin system coating agent on the rubber sheet without using the PET. The application of the fluororesin system coating agent on the rubber sheet makes the thickness of the coating layer less than that of the conventional resin sheet, and as PET is not used, the sound-absorbing function of the rubber sheet can be enhanced, and an adhesion step for a PET film and polytetrafluoroethylene resin sheet can be eliminated, thereby reducing work processes. It should be noted that a highly lubricative coating layer can be formed on a rubber sheet by first applying an adhesive on the rubber sheet and then applying a pure fluororesin system coating agent having no adhesive by means of a spray or the like.

Preferably, the fluororesin system coating agent may be an polytetrafluoroethylene resin. A mixture of the fluororesin system coating agent of 95% in weight and the adhesive (prior to be hardened) of 5% in weight is preferable. If the fluororesin system coating agent is less than 95% in weight, lubrication of the agent becomes poor. If the adhesive is less than 5% in weight, adhesion becomes poor.

The rubber sheet is formed into an annular shape and provided on one surface thereof with the highly lubricative layer having a thickness of 1 to 10 $\mu$m and on the other surface thereof with a separable paper through an adhesive applied to the other surface. Preferably, the annular-shaped rubber sheet having a thickness of 1 mm may be provided on one side with the highly luburicative coating layer having a thickness of 3 $\mu$m.

In the case of attaching the highly lubricative sound-absorbing material to the bearing surface of the cable containing chamber in the cable reel, the fluororesin system coating agent is applied onto the rubber sheet which has been formed into an annular shape beforehand, thereby greatly reducing a quantity of a resin to be used such as the polytetrafluoroethylene resin in comparison with conventional sound-absorbing sheets. That is, the thickness of the highly lubricative sound-absorbing material in the present invention is around 3 $\mu$m while the polytetrafluoroethylene resin sheet having a thickness of 20 Mm in the prior art is formed into an annular shape by means of punching or blanking. Consequently, the present invention can reduce greatly consumption of resin and lower production costs.

A cable reel of the present invention comprises: a stationary element assembly; a movable element assembly rotatably mounted on said stationary element assembly; a cable containing chamber formed into an annular configuration by the stationary and movable element assemblies, the chamber being adapted to contain a flat cable in a swirl manner therein; and means for electrically leading lateral opposite ends of the flat cable out from the stationary and movable element assemblies, respectively. The highly lubricative sound-absorbing material of the present invention described above is attached to at least one of bearing surfaces of the cable containing chamber which are faced to lateral opposite edges of the flat cable. The one of bearing surfaces is adapted to bear a weight of the flat cable.

The cable reel described above is attached to a steering device of an automotive vehicle to supply electrical power to an air bag system. When the movable element assembly which rotates with a steering wheel is turned to one direction, the flat cable is wound in the cable containing chamber in the cable reel while the flat cable is unwound when the assembly is turned in the other direction.

The lateral opposite edges of the flat cable, in particular, the lateral lower edge which is subject to its own weight, slide on the bearing surfaces of the cable containing chamber, in particular the lower bearing surface during rotary motion. Since the highly lubricative thin coating layer made of the polytetrafluoroethylene resin or the like is formed on the rubber sheet mounted on the bearing surface of the cable containing chamber, it is possible to allow the flat cable to smoothly rotate on the bearing surface, thereby suppressing sliding noise. Even if the flat cable vibrates in the axial direction of the cable reel due to vibration of the engine during an idling mode or a driving mode and the lateral lower edge of the flat cable collides on the lower bearing surface of the cable containing chamber, the unpleasant vibration noise is absorbed by the rubber sheet and the sliding noise is attenuated by the highly lubricative coating layer. In particular, since the highly lubricative coating layer on the rubber sheet is extremely thin, the layer does not interfere with the sound-absorbing function of the rubber sheet.

DETAILED DESCRIPTION OF THE PREFERRED EMBODIMENTS

Figure 1:
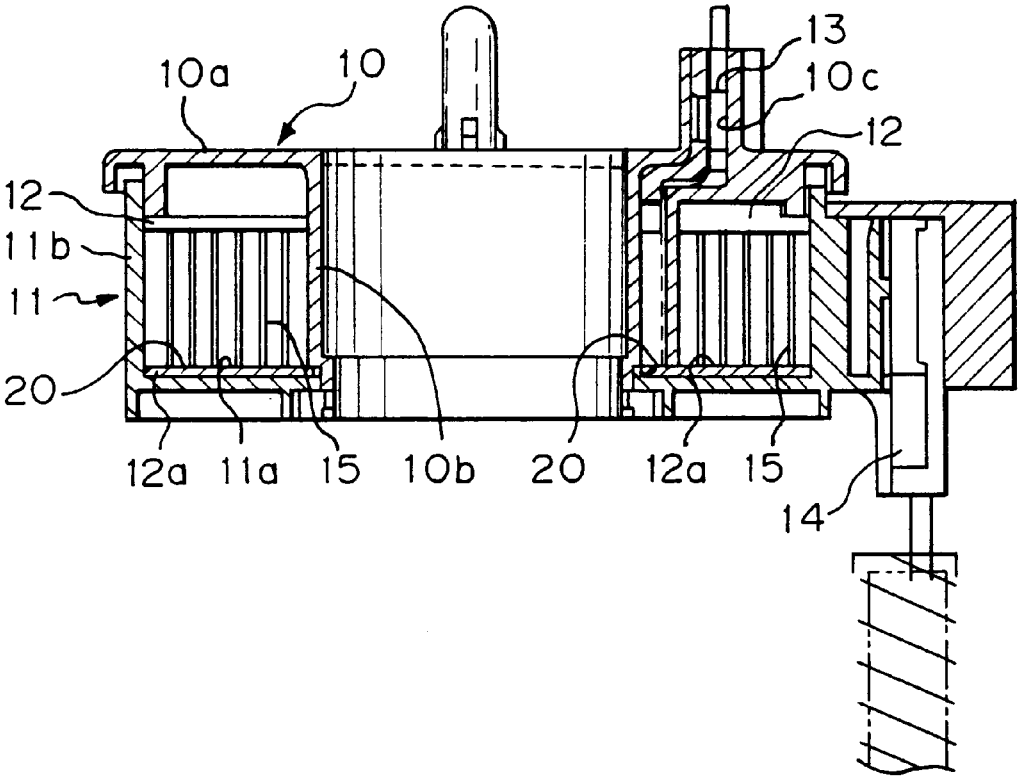
FIG. 1 is a schematic longitudinal sectional view of a cable reel in accordance with the present invention.

Embodiments of a highly lubricative sound-absorbing material and a cable reel including the same in accordance with the present invention will be explained below by referring to FIG. 1 to FIGS. 4A and 4B. In an embodiment of the present invention, the highly lubricative sound-absorbing material is attached to a cable reel mounted on a steering device in an automotive vehicle. A main body of the cable reel of the present invention has the same structure as that of the conventional cable reel shown in FIG. 5.

The cable reel of the present invention includes a movable element assembly 10 which is secured to a steering wheel (not shown) to be turned together with it, and a stationary element assembly 11 which is secured to a shaft (not shown) fixed on a body frame. The movable element assembly 10 has an upper wall 10*a* and an inner peripheral wall 10*b* while the stationary element assembly 11 has a lower wall 11*a* and an outer peripheral wall 11*b*. The movable and stationary element assemblies 10 and 11 define and annular cable containing chamber 12.

The cable containing chamber 12 accommodates a flat cable 15 in a swirl manner. An inner end of the flat cable 15 in swirl manner is connected to a lead wire 13 which is led out through an attaching hole 10*c* in the upper wall 10*a* of the movable element assembly 10. An outer end of the flat cable 15 in swirl manner is connected to a lead wire 14 which is led out from the stationary element assembly 11. The flat cable 15 is wound in the cable containing chamber 12 when the steering wheel is turned in one direction while the flat cable 15 is unwound in the chamber 12 when the steering wheel is turned in the other direction. Thus, the lead wires 13 and 14 are electrically coupled to each other through the flat cable 15, even if the steering wheel is turned to either direction.

Figure 2:
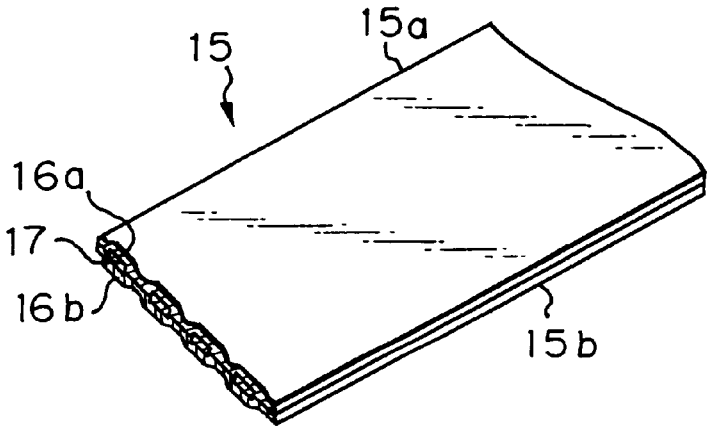
FIG. 2 is a perspective view of a part of a flat cable to be accommodated in a cable containing chamber in the cable reel shown in FIG. 1.
Figure 3:
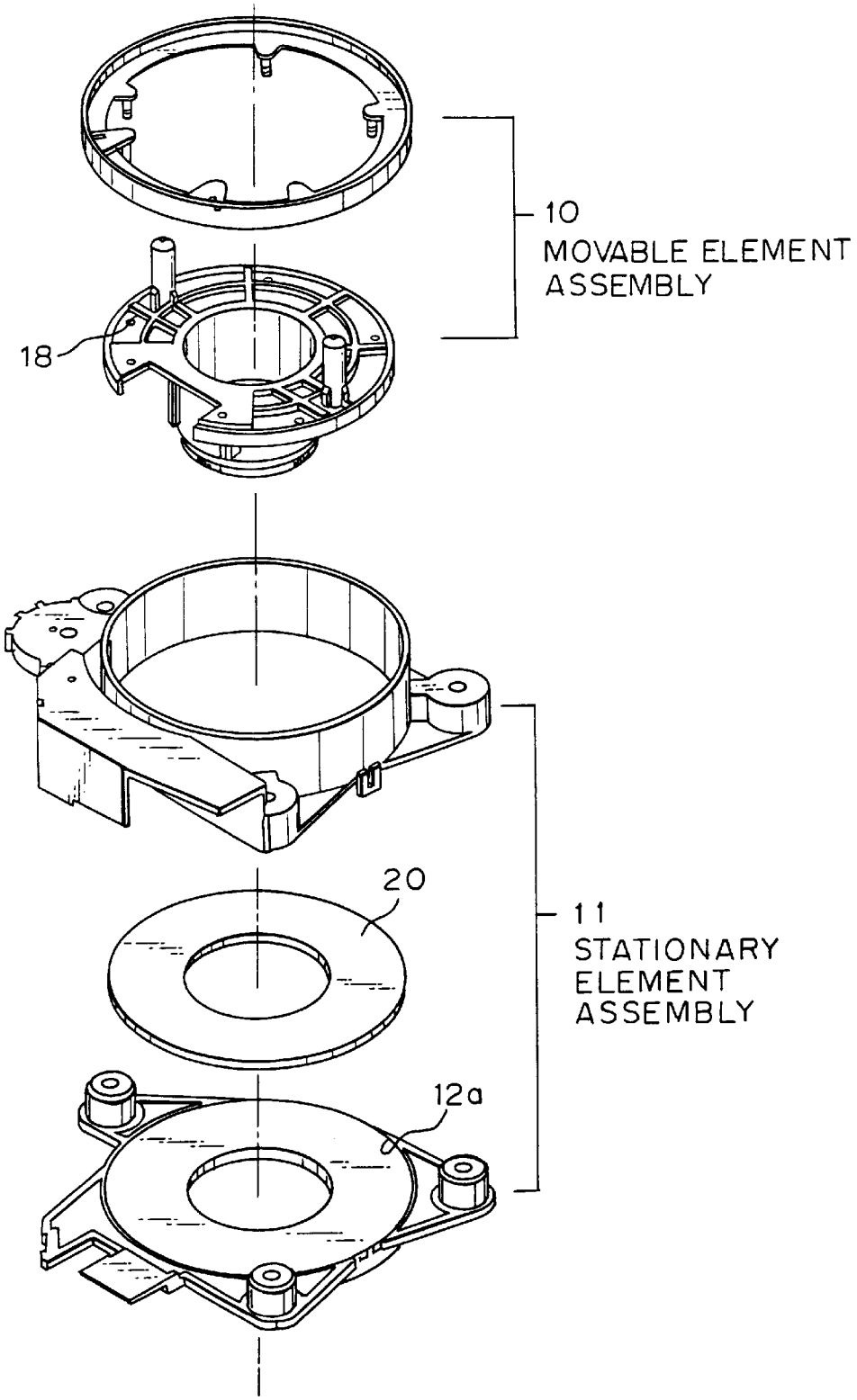
FIG. 3 is an exploded perspective view of the cable reel shown in FIG. 1, illustrating main elements constituting the cable reel.

The flat cable 15, as shown in FIG. 2, includes a pair of insulation resin films 16*a* and 16*b*, and a conductive material 17 interposed between the films 16*a* and 16*b*. The flat cable 15 is wound and unwound in the cable containing chamber 12 while either one of lateral opposite edges 15*a* and 15*b* of the flat cable 15 is sliding on a lower annular flat bearing surface 12*a* of the cable containing chamber 12. Accordingly, a highly lubricative sound-absorbing material 20 is mounted on the lower bearing surface 12*a*, as shown in FIG. 3.

On the other hand, the cable containing chamber 12 is provided on the upper wall with a plurality of elongate ribs 18 each of which extends radially and is spaced at a given distance in the circumferential direction. There is a slightly small clearance between the ribs 18 and the lateral upper edge 15*a* of the flat cable 15. Thus, no sliding noise is caused on the upper side in the cable containing chamber. The highly lubricative sound-absorbing material 20 may be mounted on the upper flat annular wall of the cable containing chamber 12 without providing the ribs 18 on the wall.

Figure 4A:
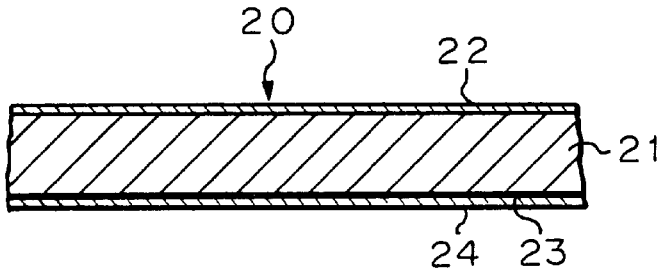
FIG. 4A is a fragmentary enlarged cross sectional view of a highly lubricative sound-absorbing material in accordance with the present invention.
Figure 4B:
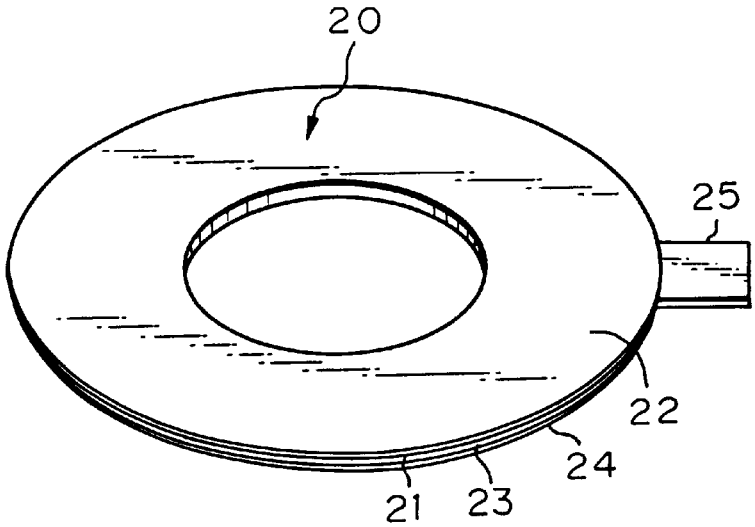
FIG. 4B is a perspective view of the highly lubricative sound-absorbing material to which a separable paper is attached.
Figure 5:
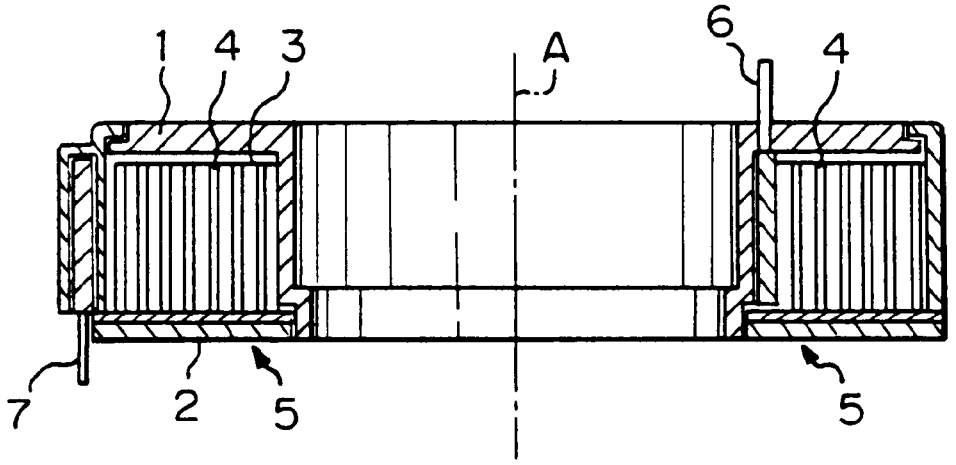
Fig. 5 PRIOR ART
FIG. 5 is a schematic longitudinal sectional view of a conventional cable reel.
Figure 6:
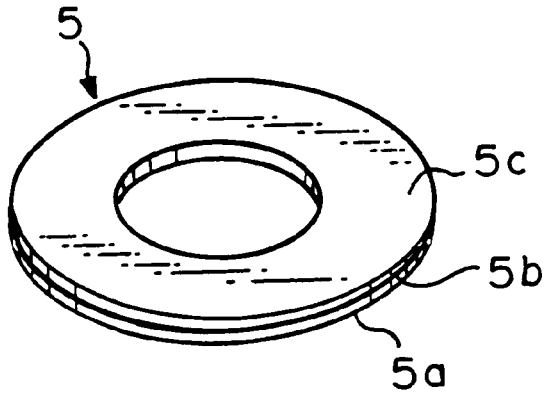
Fig. 6 PRIOR ART
FIG. 6 is a perspective view of a conventional sound-absorbing material.

As shown in FIGS. 4A and 4B, the highly lubricative sound-absorbing material 20 includes an annular rubber sheet having a thickness of 1 mm and a highly lubricative coating layer 22 made of an polytetrafluoroethylene resin, having a thickness of about 3 $\mu$m, and disposed on the upper surface of the rubber sheet 21. Before attaching the highly lubricative sound-absorbing material 20 to the lower bearing surface 12*a* of the cable containing chamber 12, an adhesive 23 is applied to the lower surface of the rubber sheet 21 and a separable paper 24 covers the lower surface. When attaching the material 20 to the surface 12*a*, the separable paper 24 is removed from the rubber sheet 21. In order to make it easy to strip the separable paper 24 from the rubber sheet 21, a tongue 25 may be provided on the outer periphery of the separable paper 24.

A method for forming the highly lubricative sound-absorbing material 20 will be explained below. First, an adhesive in liquid form (for example, an acrylic system adhesive) is mixed in the polytetrafluoroethylene resin and such a mixed liquid is sprayed on the annular rubber sheet 21 to form a layer having a given thickness (for example, 3 $\mu$m). After applying the mixed liquid on the sheet 21, it is heated at a given temperature to harden it and then the highly lubricative coating layer 22 is formed on the upper surface of the rubber sheet 21. At that time, although it is difficult to adhere an polytetrafluoro-ethylene resin through an adhesive to the rubber sheet 21, a mixture of the polytetrafluoroethylene resin in liquid form and the adhesive in liquid form can be securely adhered to the rubber sheet.

The highly lubricative sound-absorbing material 20 is adhered to the lower bearing surface 12*a* of the cable containing chamber 12 by means of the adhesive 23. When the lateral lower edge 15*b* of the flat cable 15 slides on the highly lubricative coating layer 22 made of the polytetrafluoroethylene resin, the sliding noise is attenuated. When vibration noise is generated by the axial vibration of the flat cable 15 during the idling mode or the driving mode of the engine, the rubber sheet can absorb such vibration noise. In particular, since the highly lubricative coating layer 22 is formed into an extremely thin layer of less than 10 $\mu$m (preferably, 3 $\mu$m in this embodiment) although the layer 22 itself is hard, the layer 22 does not interfere with the sound-absorbing function of the rubber sheet 21. Consequently, the vibration noise as well as the sliding noise can be reduced by the highly lubricative sound-absorbing material 20.

It should be noted that the cable reel of the present invention can be attached to not only the steering device but also a similar device. Also, the highly lubricative sound-absorbing material of the present invention can be attached to not only the bearing surface or surfaces of the cable containing chamber but also a surface on which a member slides and collides in order to attenuate the sliding noise and the vibration noise.

It will be apparent from the foregoing that it is possible to make the thickness of the highly lubricative coating layer very thin, since it is formed by spraying a liquid mixture of an adhesive and a fluororesin system coating agent directly onto the surface of the rubber sheet.

Consequently, the bearing surface which bears a lateral edge of the flat cable has a good lubrication, thereby reducing the sliding noise. Also, since the highly lubricative coating layer is extremely thin, it does not injure the sound-absorbing function of the rubber sheet but enhance such function. Thus, the highly lubricative sound-absorbing material according to the present invention can attenuate both sliding noise and vibration noises effectively.

A quantity of the expensive polytetrafluoroethylene resin to be used is reduced by 10 to 50% in comparison with the conventional polytetrafluoroethylene resin sheet formed into annular shape by a punching or blanking manner, since the highly lubricative coating layer is very thin and the spraying requires a minimum quantity of the resin. Consequently, it is possible to greatly lower a cost of the sound-absorbing material.

Further, in comparison with the conventional method in which the PET film is adhered to the rubber sheet through the adhesive and then the polytetrafluoroethylene resin sheet is adhered to the PET film through the adhesive, the highly lubricative sound-absorbing material of the present invention can be formed merely by applying the fluororesin system coating agent to the surface of the rubber sheet. Consequently, it is possible to further lower the cost.

The entire disclosure of Japanese Patent Application No. 333,651/1996 filed on Dec. 13th, 1996 including specification, claims, drawings and summary is incorporated herein by reference in its entirety.

What is claimed is:

1. A cable reel for use on a vehicular steering column comprising:

a stationary element assembly;

a movable element assembly rotatably mounted on said stationary element assembly;

a cable containing chamber formed into and annular configuration by said stationary and movable element assemblies, said chamber being adapted to contain a flat cable in a swirl manner therein;

means for electrically leading opposite ends of said flat cable out from said stationary and movable element assemblies, respectively; and a highly lubricative sound-absorbing material attached to at least one of bearing surfaces of said cable containing chamber which face opposite lateral edges of said flat cable, said one of bearing surfaces being adapted to bear a weight of said flat cable, said highly lubricative sound-absorbing material comprising three layers, one layer being a rubber sheet having a thickness of about 1 mm, a second layer being a highly lubricative layer formed directly on one surface of said rubber sheet by coating said surface with a mixture of a fluororesin system coating agent and an adhesive, said highly lubricative layer having a thickness of about 1 to about 10 $\mu$m, and a third layer being an adhesive on the other surface of said rubber sheet so as to adhere said highly lubricative sound-absorbing material to said bearing surfaces.

2. The cable reel of claim 1 wherein said fluororesin system coating agent is a polytetrafluoroethylene resin.

3. The cable reel of claim 1 wherein the mixture comprises about 95% by weight of said fluororesin system coating agent and about 5% by weight of said adhesive.

4. The cable reel of claim 1 wherein said highly lubricative layer has a thickness of about 3 $\mu$m.

5. The cable reel of claim 1 wherein the fluororesin system coating agent is a polytetrafluoroethylene resin.

6. The cable reel of claim 1 wherein said rubber sheet has a thickness of about 1 mm and said highly lubricative layer has a thickness of about 3 $\mu$m.

* * * * *